114-242 SR
6/3/80 XR 4,205,619

United States Patent [19]
Mock, Jr. et al.

[11] 4,205,619
[45] Jun. 3, 1980

[54] AUTOMATIC FLARE SIGNAL APPARATUS

[76] Inventors: George W. Mock, Jr., 5315 Carinleigh, Houston, Tex. 77084; George W. Mock, Sr., 13206 Boca Raton, Houston, Tex. 77069

[21] Appl. No.: 937,473

[22] Filed: Aug. 28, 1978

[51] Int. Cl.[2] ..... G08B 21/00
[52] U.S. Cl. ..... 116/67 R; 114/242; 115/6; 340/29
[58] Field of Search ..... 116/26, 67 R, 81, 83, 116/114 AC, 124 B, DIG. 40, 16 R; 114/242, 247, 252, 253; 115/6, 6.1, 7; 340/29, 309.3, 309.4, 500, 531, 540; 42/1 R; 102/31, 37.7

[56] References Cited

U.S. PATENT DOCUMENTS

| | | | |
|---|---|---|---|
| 662,774 | 11/1900 | Davis | 115/6 |
| 2,789,501 | 4/1957 | Sawicki | 116/DIG. 40 |
| 2,810,120 | 10/1957 | Parker | 116/67 R |
| 3,428,942 | 2/1969 | Isaacson | 116/67 R X |
| 3,759,094 | 9/1973 | Al | 340/29 X |
| 3,764,971 | 10/1973 | Brobeck | 340/29 |
| 4,058,792 | 11/1977 | Soltesz | 116/26 X |

*Primary Examiner*—Donald Watkins
*Attorney, Agent, or Firm*—Arthur M. Dula

[57] ABSTRACT

An apparatus for indicating breakage of a tensioned rope, or chain or the like by firing flares or other warning signals. In the preferred embodiment, an auxiliary cable running parallel to the towing or mooring cable is used to actuate firing of a first flare and to simultaneously activate a timing mechanism. Said timing mechanism fires a series of flares in a predetermined sequence. This combination allows both an immediate indication of a hazard and quick localization and recovery of a detached boat or vehicle.

10 Claims, 6 Drawing Figures

AUTOMATIC FLARE SIGNAL APPARATUS

BACKGROUND OF THE INVENTION

1. Field of the Invention

The present invention relates generally to triggering a series of signals in response to the parting of towing or mooring lines. More particularly, the present invention relates to a mechanical firing mechanism for actuating flares in a timed sequence so as to indicate both that the towing lines have parted and to aid location and recovery of the detached vehicles.

2. Background of the Prior Art

It is common for a single tugboat to tow a plurality of barges. Since barges are usually unmanned, and broken tow lines often cause barges to become detached, the tug operator may not become aware that a barge has broken loose in time to avoid costly loss, harm or damage. Quick recovery of a barge is extremely important when the cargo is of a chemical or petroleum nature where spillage or loss would have a serious detrimental effect on the ecology. The dangers and likelihood of such unnoticed separation are greatly increased under conditions of limited visibility, particularly fog or dense rain or during night towing operations. Also barges typically present a very low visual and radar profile, especially when they are loaded. They tend to be easily hidden by high seas and can be difficult to find in inclement weather. Under these circumstances even a slight delay in discovering that a barge has broken its tow line can be disastrous because the free barge is quickly lost to view. Tugs have low maneuverability and are slow. Thus, to avoid damage in crowded shipping lanes, such as exist in navigable rivers, inland waterways and in most parts of the world, it is absolutely mandatory that any breakage of tow lines be immediately discovered and the lost barge recovered even when weather conditions limit visibility.

The prior art in this field has conspicuously failed to provide a simple and reliable means for signaling the presence of a loose barge and in such a way as to aid its recovery. Known devices in this area, such as those disclosed in U.S. Pat. No. 3,727,212, issued to Jones, and U.S. Pat. No. 4,058,792, issued to Sóltesz typically consist of complicated electromagnetic signaling devices for indicating undesired motions of anchored boats. Such systems characteristically require sensor devices separate and apart from a ship's mooring or anchoring devices. The prior art known to the inventor does not teach an immediate signaling means combined with a time-delayed signaling means for promoting the rapid recovery of a loose vessel, such as a barge.

SUMMARY OF THE PRESENT INVENTION

The present invention discloses an alarm and recovery assistance device for signaling the parting of lines in tension. The apparatus comprises attachment means for securing different structures, e.g. tug boats and barges and boats and buoy, to one another; sensor means for signaling separation between the various structures beyond the limit set by the attachment means; and a triggering means responsive to said sensor means for actuating signals such as flares both immediately and at preset intervals after the initial signal.

More particularly, the present invention provides a simple, safe and inexpensive means for immediately indicating breakage of attachment lines as the break occurs as well as time delayed signaling means for facilitating subsequent recovery of the severed structure.

In one embodiment, a sensor line in the form of a lanyard cable strung along the attachment or towing cable is releasably attached by quick-connect plugs to a flare alarm box affixed to the towed or moored structure. A triggering bar, protruding from said box, is connected to the lanyard cable by a shear pin. When the main attachment line parts, the lanyard cable will pull the triggering bar once separation between the attached structures exceeds the limit usually set by the attachment cable. The triggering bar, once pulled outward, permits a spring loaded firing pin to strike upward through apprpriate openings into a flare storage cylinder, thereby setting off conventional signal flare.

In a second embodiment of the present invention, a timing device is connected to one end of the triggering bar. Pulling the triggering bar now actuates not only a firing pin striking a first flare, or set of flares, but also starts said timing device. The timing device actuates a second triggering bar that sets off further flares at predetermined intervals.

Yet another modification of the present invention employs a second signaling means, such as a radio transmitter, set on a distress frequency, or an acoustic signaling horn. This second signaling means is also activated by the sensor line or lanyard cable being pulled.

DESCRIPTION OF THE PREFERRED EMBODIMENTS

Figure 1:
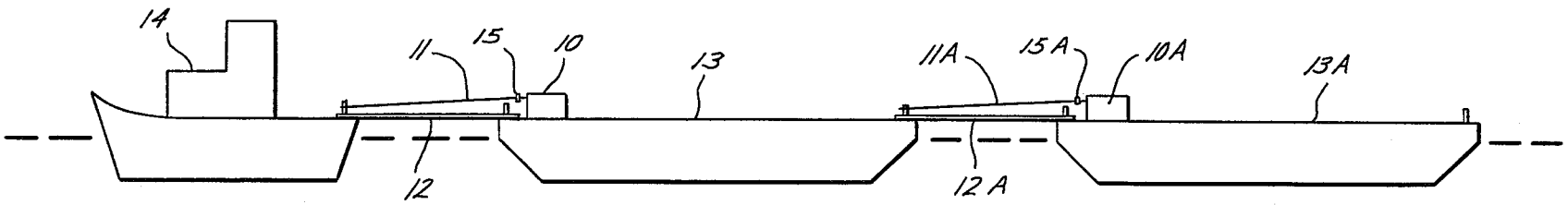
FIG. 1 is a view illustrating the flare signaling apparatus taught by the preferred embodiment of the present invention employed in barge towing operations.

Referring to the drawings, FIG. 1 illustrates diagramatically how the present invention is used in barge towing. The flare alarm box of the present invention is generally indicated 10. A lanyard cable 11 connects the actuating mechanism of barge and through a quick-connect device 15 to the rear of tug boat 14. A slightly shorter main attachment cable 12 is also attached to the front barge 13 and the rear of tug 14.

A main attachment cable 12A connects the rear of barge 13 to the front of barge 13A. The rear of barge 13 is also connected through second lanyard cable 11A through quick-connect device 15A to the flare alarm box 10A affixed to barge 13A.

Figure 2:
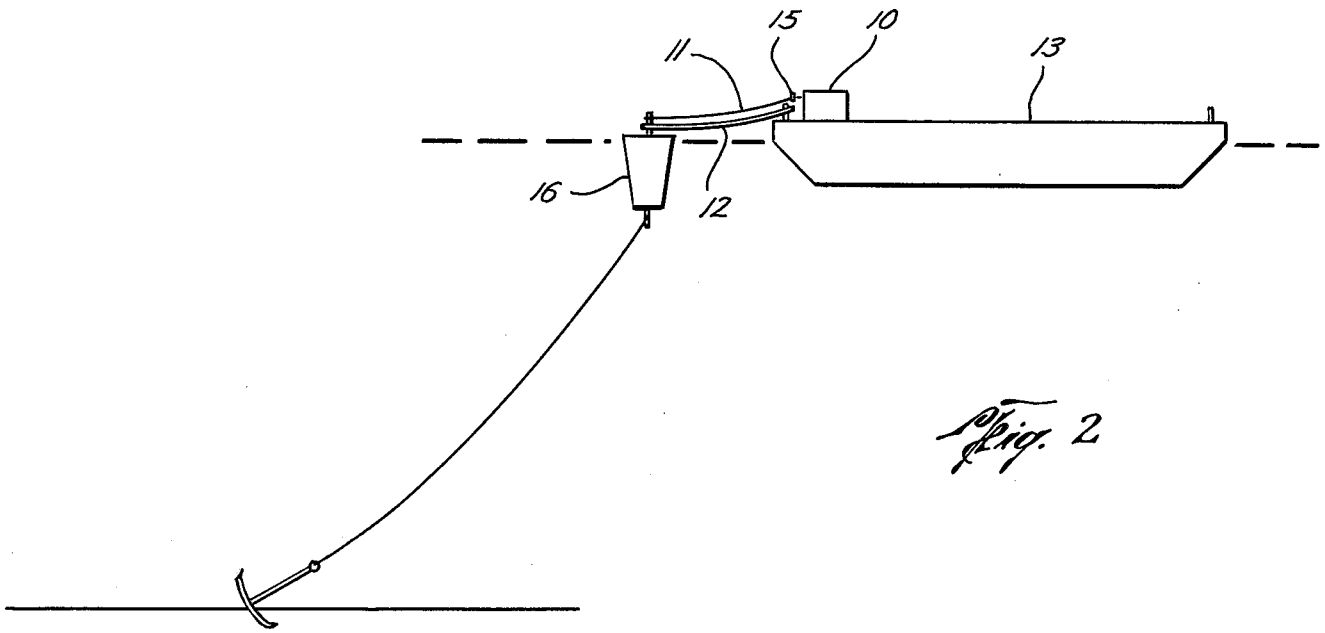
FIG. 2 illustrates employment of the preferred embodiment of the present invention used for mooring boats or barges.

Another use of the same basic elements is illustrated in FIG. 2 wherein barge 13 is moored via main attachment line 12 to an anchored buoy 16. Lanyard cable 11, which is also attached to bouy 16, is strung parallel to mooring line 12 and attached to flare alarm box 10, either directly or via a quick-connect plug 15, as described above.

Figure 3:
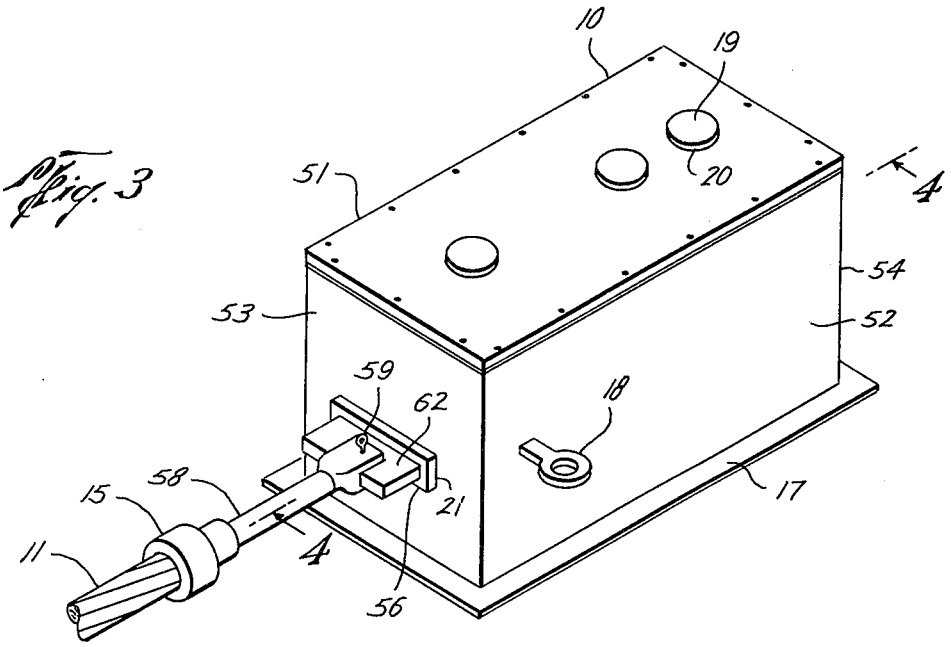
FIG. 3 is an enlarged illustration of the flare alarm box taught by the preferred embodiment of the present invention.
Figure 4:
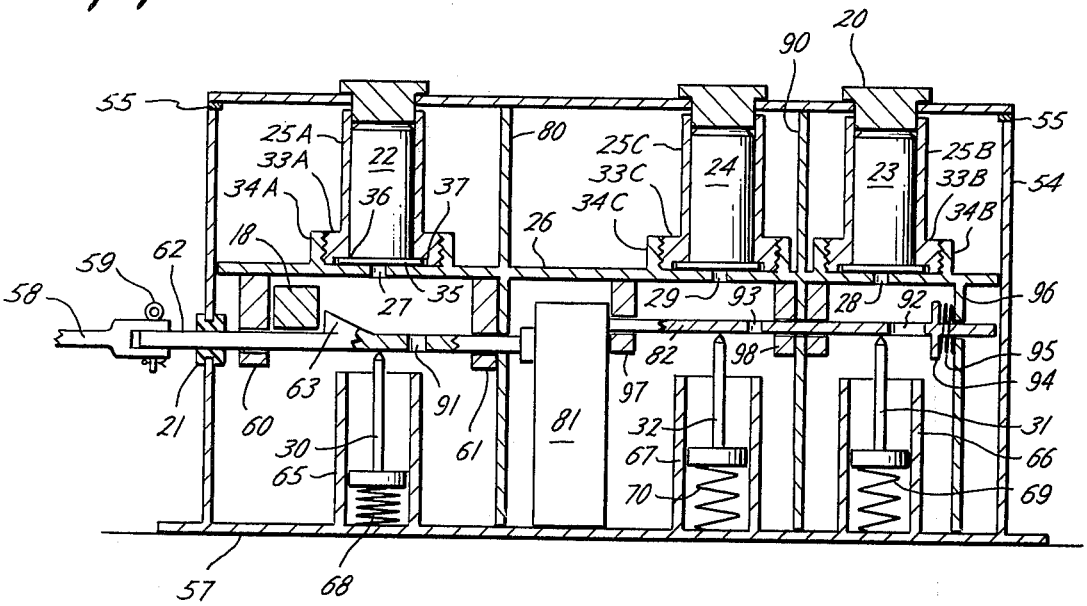
FIG. 4 is a cross-sectional view taken along the line A—A of FIG. 3 illustrating the internal construction of the flare alarm box of the present invention.

Referring to FIG. 3, flare alarm box 10 is depicted generally being a rectangular box bolted or welded to barge 13 along its bottom edge 17. The top of box 10 defines a number of flare port openings 19 from which the flares are ejected once triggered and ignited. Such flare port openings 19 are protected against the intrusion of water by plastic or rubber caps 20, which hermetically seal off the flare storage cylinder until they are ejected by a flare. For the sake of illustration, FIG. 3, as well as FIG. 4 show flare alarm box 10 as having three flare port openings, but, of course, the invention contemplates any number of flares and flare port openings as may be required by operational circumstances.

A safety stop 18 is shown protruding from one of the sidewalls 52 of box 10. Safety stop 18, when inserted, prevents accidental firing of flares during adjustment or hook-up operations. The internal triggering mechanism of flare alarm box 10 is effectively blocked and not rendered operative unless and until safety stop 18 is released.

Trigger bar 62 extends outside box 10 through opening 56 of box 10. Trigger bar 62 is attached to lanyard cable 11 by quick-connect plug 15. Quick-connect plug 15 is connected to bar 62 by short cable 58 and shear pin 59, which passes through a hole in bar 62 (not shown). Trigger bar opening 56 is sealed against the intrusion of water into the interior of box 10 by rubber gasket 21.

The top plate 50 of flare alarm box 10 is releasably attached to sidewalls 51, 52 and front plate 53 and rear plate 54 by means of bolts, screws or other removable fasteners to provide access to the interior of box 10 for the purpose of loading flares, removing expended shells and general maintenance.

The internal mechanism of flare alarm box 10 can best be described with reference to FIG. 4. Flares 22, 23 and 24 are shown in their respective flare storage cylinders 25A, 25B and 25C. The flare storage cylinders themselves are mounted on an internal partition 26. Within each flare storage cylinders 25A, 25B and 25C concentrically located pin hole openings 27, 28 and 29, respectively, penetrate platform 26 in register with the flares firing caps or primers provide these openings access for firing pins 30, 31 and 32, respectively, once the triggering mechanism is released. The flare storage cylinders themselves are provided with protruding, externally threaded, lower flange portions 33A, 33B and 33C, respectively, which releasingly engages with matchingly threaded rings 34A, 34B and 34C, which are welded to platform 26.

Upon removal of top plate 50, which is removably attached to box 10 with gasket 55 therebetween to hermetically seal off the interior, access to said interior containing platform 26 and flare storage cylinders 25A, 25B and 25C can be had from the top. The cylinders can then be unscrewed from their mounting rings to permit loading of flares. An annular groove 36 is provided at the bottom end of flare storage cylinder 25, wider in diameter than the flare itself. These grooves accommodate the hip 37 of firing cap 35 at the bottom of the flare cartridge and provide sufficient mechanical restraint along shoulder 37 to permit a firing pin to penetrate the cap and set off the flare.

In the preferred embodiment the triggering mechanism would consist of one directly activated, mechanical trigger bar 62 and a separate spring loaded timing device 81, which in turn activates a second mechanical trigger bar 82 after some suitably set time delay.

The first trigger bar 62 is slideably mounted between guides 60 and 61 and is attached at one end by shear pin 59 to connector bar 58 and at the other end to the schematically indicated timed firing device 81. Trigger bar 62 is equipped with pin hole opening 91 and a triangular protrusion 63, which abuts safety stop 18 so long as the safety stop is inserted in box 10. When safety stop 18 is disengaged, trigger bar 62 is free to slide forward when pulled by cable 11 so as to bring firing pin passage 61, firing pin 30 and firing pin passage 27 into operative alignment. Firing pin 30 is mounted atop spring coil 68 which in turn is mounted within spring cylinder 65 attached to base plate 57. When trigger bar 62 is pulled out of box 10 then firing pin passages 61 and 27 are in vertical alignment and spring pressure from coil 68 will drive firing pin 30 upward causing it to strike firing cap 35 and set off flare 22.

Trigger bar 62, when moved to fire flare 22, will also start timing device 81. Timing device 81 comprises any clockwork, spring loaded or otherwise activated, mechanism capable of either pulling forward or of restricting the forward motion of second trigger bar 82. Only the release form of timing mechanism is shown in FIG. 4. As shown, second trigger bar 82 is slideably mounted between guides 97 and 98 and section plate 96. A coiled spring 95 is inserted between wall 96 and backstop 94, which is formed in the terminal end of trigger bar 82. Spring 95 is under compression, and provides the driving force for moving bar 82 so firing openings 92 and 93 are in alignment with firing pins 31 and 32. In the embodiment shown in FIG. 4, firing pin openings 92 and 93 are arranged in such a way that in their initial rest position pin 31 is located closer to opening 93 than the pin 32 is to opening 93. As shown, firing pin 31, housed in cylinder 66 and driven by spring 69, would be the first to reach and set off its flare 23 when trigger bar 82 moves forward under the control of timing device 81, i.e. at some first time interval, after being triggered by first trigger bar 62. Firing pin opening 92 is in the form of an elongated rectangular slot, rather than a circular opening, to permit further movement of bar 82 after flare 23 has been ignited. Thus, when the timing device 81 permits spring 95 to push bar 82 forward to its ultimate rest position, firing pin 31, will be in slot 92 and will not interfere with the triggering of flare 24.

Figure 5:
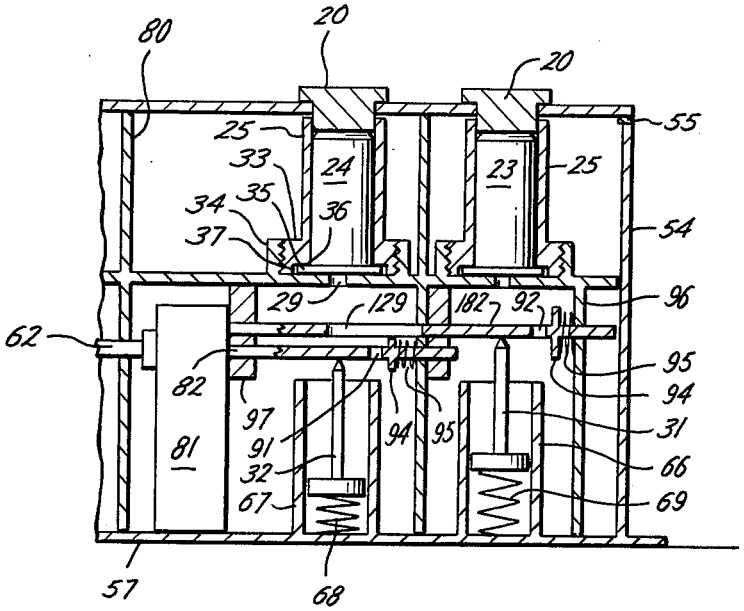
FIG. 5 is a cross-sectional view of an alternative embodiment of the time delayed triggering mechanism.

Another embodiment of the present invention's time delayed recovery-assistance flare triggering mechanism is shown in FIG. 5. In that variation of the preferred embodiment, timing device 81 activates two trigger bars 82 and 182. An extended secondary firing pin slot 129 along secondary trigger bar 182 permits either flare 23 or 24 to be set off before the other, depending solely upon the setting of the internal release mechanism of timing device 81.

Figure 6:
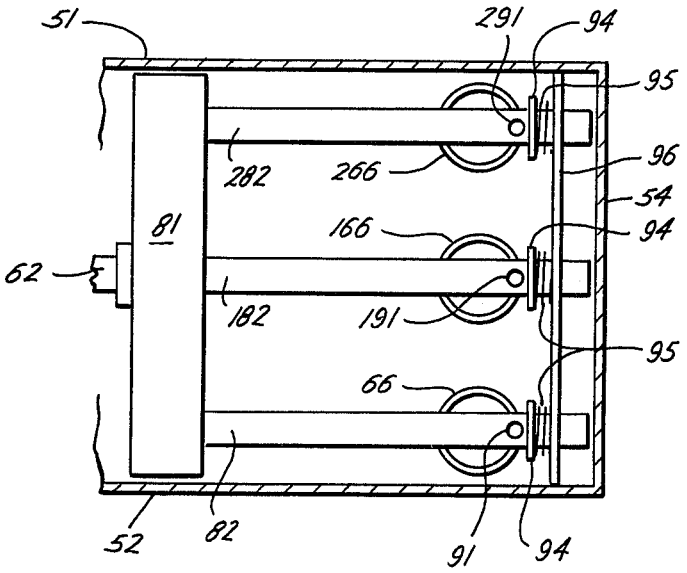
FIG. 6 is a top partially cut away of yet another embodiment of the present invention illustrating a parallel firing arrangement for delayed recovery-assistance flares.

FIG. 6 shows a top view of yet another variation of the preferred embodiment. Since circumstances may require a large number of flares to be set off at time intervals, i.e. where one might reasonably anticipate particularly difficult recovery conditions, arranging all flares in series behind timing device 81 might result in flare boxes that are too long to be placed on the barge's deck. The invention solves this problem by providing parallel rows of flares and trigger bars. A parallel arrangement of three such trigger bars 82, 182 and 282 is shown in FIG. 6. Also depicted are their respective firing pin openings 91, 191 and 291 as well as the corresponding firing pin spring cylinders 66, 166 and 266. The firing sequence of the flares in this arrangement is again determined wholly by settings of the internal release mechanism of timing device 81. Of course, various combinations of parallel and in-series arrangements of flares could also be used wherever necessary or desirable.

The above embodiments of the present invention are only illustrative of alarm signaling means especially helpful for seafaring usage. Clearly, towing operations on land could also benefit from the described invention's simple mechanical signaling mechanism responsive to immediate separation between towed and towing vehicles and/or permitting time delayed alarm signal emissions for subsequent recovery. To that end, other commonly known alarm signaling means such as flashing lights, acoustic horns or sirens, or intermittent radio signals could all be employed in conjunction with the described alarm signaling and triggering means.

It should be appreciated from the foregoing disclosure that the description of the present invention is primarily illustrative and explanatory thereof, and that various changes in size, shape, arrangement and materials as well as in the details of the illustrated construction may be made within the scope of the appended claims and their equivalents without departing from the present invention.

I claim:

1. An apparatus for signaling separation between a first structure and a second structure, comprising:

attachment means for connecting the first structure and the second structure, said attachment means including an elongate member of a predetermined length;

signaling means responsive to the disconnection of said attachment means for indicating said disconnection, said sign means including a lanyard cable running parallel to said attach means, said lanyard cable being substantially the same length said elongated member, said length of said lanyard cable being such that siad lanyard cable is subjected to tension stresses said disconnection of said attachment means;

an alarm box attached to the second structure, including alarm means for alerting operators of said disconnection of said attachment means substantially immediately upon the happening of said disconnection; and triggering means inside said alarm box for activating said alarm means, said triggering means being connected to said signalling means, said triggering means being activated by said signaling means.

2. The device of claim 1 wherein said alarm means includes at least one signal flare within said alarm box.

3. The device of claim 2 wherein:

said triggering means include a trigger bar with at least one firing pin passage opening therethrough;

said lanyard cable is removably attached to said trigger bar;

said trigger bar extends into the interior of said alarm box, therein depressing at least one spring loaded firing pin located between said signal flare and the bottom plate of said alarm box; and said firing pin and said firing pin passage opening through said trigger bar are not initially in line with one another, but become aligned when said trigger bar is pulled out of said alarm box upon said disconnection of said attachment means, thus enabling said firing pin to strike and set off the firing cap of said signal flare located concentrically above said firing pin.

4. The device of claim 3 wherein said trigger bar is shaped in such a way that a safety stop can be inserted from one of the sides of said alarm box, said safety stop abutting an elevated protrusion on said trigger bar and thereby preventing any forward motion of said trigger bar so long as said safety stop is not removed from said alarm box.

5. An apparatus for signaling separation between a first and a second structure and for relocating such second structure after separation, comprising:

an attachment means for connecting the first structure and the second structure;

signaling means responsive to the disconnection of said attachment means for indicating said disconnection;

an alarm box attached to the second structure including alarm means for alerting operators of said disconnection of said attachment means and for assisting in the subsequent recovery of the second structure;

triggering means for activating said alarm means, said triggering means being connected to said signaling means, said triggering means being activated by said signaling means; and a timing device within said alarm box for triggering at least one other of said alarm means sometime after said disconnection of said attachment means.

6. The device of claim 5 wherein said attachment means includes an elongated member of a pre-determined length and said signaling means include a lanyard cable running parallel to said attachment means, said lanyard cable being substantially the same length as said elongated member, said length of said lanyard cable being such that said lanyard cable is subjected to tension stresses after said disconnection of said attachment means.

7. The device of claim 6 wherein said alarm means includes a plurality of signal flares within said alarm box.

8. The device of claim 7 wherein:

said triggering means includes a first trigger bar with at least one firing pin passage opening therethrough;

said lanyard cable is removably attached to said first trigger bar;

said first trigger bar is extending into the interior of said alarm box, therein depressing at least one spring loaded firing pin located between said signal flare and the bottom plate of said alarm box;

said firing pin and said firing pin passage opening through said first trigger bar are not initially in line with one another but become aligned when said trigger bar is pulled out of said alarm box upon said disconnection of said attachment means, thus enabling said firing pin to strike and set off the firing cap of said signal flare located concentrically above said firng pin; and said first trigger bar is connected with said timing device and triggers said timing device when said first trigger bar is pulled out of said alarm box upon said disconnection of said attachment means.

9. The device of claim 8 wherein said first trigger bar is shaped in such a way that a safety stop can be inserted from one of the sides of said alarm box, said safety stop abutting an elevated protrusion on said first trigger bar and therby preventing any forward motion of said first trigger bar so long as said safety stop is not removed from said alarm box.

10. The device of claim 8 or claim 9 wherein:

said triggering means includes at least one other second trigger bar with at least one firing pin passage therethrough;

at least one said second trigger bar is biasing against at least one second spring loaded firing pin located between said second signal flare and the bottom plate of said alarm box;

said second trigger bar is activated by said timing device some time after said disconnection of said attachment means; and said second firing pin and said firing passage through said second trigger bar are not initially in line with one another but become aligned only when said second trigger bar is activated by said timing device, thus enabling said second firing pin to strike and set off the firing cap of said second flare located concentrically above said second firing pin.

* * * * *